US007291794B2

(12) United States Patent
Woods

(10) Patent No.: US 7,291,794 B2
(45) Date of Patent: Nov. 6, 2007

(54) MAGNETIC SWITCH ASSEMBLY

(75) Inventor: Randall Woods, Sun Lake, AZ (US)

(73) Assignee: Magnasphere Corporation, Waukesha, WI (US)

( * ) Notice: Subject to any disclaimer, the term of this patent is extended or adjusted under 35 U.S.C. 154(b) by 0 days.

(21) Appl. No.: 11/278,644

(22) Filed: Apr. 4, 2006

(65) Prior Publication Data

US 2006/0260918 A1 Nov. 23, 2006

Related U.S. Application Data

(60) Provisional application No. 60/671,578, filed on Apr. 15, 2005.

(51) Int. Cl.
*H01H 3/16* (2006.01)

(52) U.S. Cl. ..... 200/61.62; 335/205; 200/61.72

(58) Field of Classification Search ..... 200/61.7, 200/61.71, 61.62, 61.72, 61.73, 61.45 M; 335/205–207; 340/545.1, 547
See application file for complete search history.

(56) References Cited

U.S. PATENT DOCUMENTS 5,332,992 A 7/1994 Woods
5,965,855 A * 10/1999 Tanazawa et al. ... 200/61.45 M
5,977,873 A 11/1999 Woods
6,506,987 B1 * 1/2003 Woods ..... 200/61.62
6,603,378 B1 * 8/2003 Collins ..... 335/205
6,788,201 B2 * 9/2004 Chen et al. ..... 340/540
6,803,845 B2 * 10/2004 Woods ..... 335/207
7,023,308 B2 * 4/2006 Woods ..... 335/205

* cited by examiner

*Primary Examiner*—Michael A. Friedhofer
(74) *Attorney, Agent, or Firm*—Hovey Williams LLP

(57) ABSTRACT

An improved, low-cost magnetic switch assembly (16, 16*a*) is provided having an easily fabricated housing (24, 24*a*) and cover (29, 29*a*) formed of non-conducting synthetic resin material. A pair of electrically conductive switch elements (30, 32, 30*a*, 32*a*) are positioned in spaced relationship with the housing (24, 24*a*) along with a body (40, 40*a*) shiftable between a first position in simultaneous contact with the switch elements (30, 32, 30*a*, 32*a*), and a second position out of such simultaneous contact. The housing (24, 24*a*) is also equipped with a first attractive component (38, 38*a*) which magnetically reacts with the body (40, 40*a*) to hold the latter in one of the positions thereof when the assembly (16, 16*a*) experiences a first magnetic field condition, but allows the body (40, 40*a*) to move to the other of the positions thereof when a second magnetic field condition is experienced adjacent the assembly (16, 16*a*).

15 Claims, 1 Drawing Sheet

MAGNETIC SWITCH ASSEMBLY

RELATED APPLICATION

The present non-provisional patent application claims, with regard to all common subject matter, priority benefit of a provisional patent application titled MAGNETIC SWITCH ASSEMBLY; U.S. Patent Application No. 60/671,578; filed Apr. 15, 2005. The identified provisional patent application is hereby incorporated by reference into the present non-provisional patent application.

BACKGROUND OF THE INVENTION

1. Field of the Invention

The present invention is broadly concerned with improved magnetic switches of the type described in U.S. Pat. Nos. 5,332,992 and 5,977,873. More particularly, the invention pertains to such magnetic switches which may be fabricated in large part from less expensive synthetic resin materials, rather than metallic materials, while still achieving the desirable switch operation of prior magnetic switches.

2. Description of the Prior Art

U.S. Pat. Nos. 5,332,992 and 5,977,873 describe greatly improved, high security switch products which operate on the principle of magnetic shifting. For example, the preferred switch illustrated in the '873 patent makes use of a metallic, hollow housing with a central, top-mounted electrode extending downwardly into the housing. A spherical electrical conducting ball is also positioned within the housing, and is magnetically shiftable during switch operation between a switch-closed position where the ball is in simultaneous contact with the central electrode and housing and a switch-opened position where the ball is magnetically shifted out of such simultaneous contact.

SUMMARY OF THE INVENTION

The present invention provides magnetically operated switches but are designed for lower cost production through provision of synthetic resin or other non-conductive switch housings. To this end, the switches of the invention are provided with a pair of spaced, electrically conductive electrodes strategically positioned within the housing so as to cooperate with a conductive spherical switch ball to alternately assume switch-closed and switch-opened positions.

In one embodiment, the electrodes are supported by the housing cover and extend downwardly in close adjacency with the inner surface of the housing, terminating at a low point near the housing bottom. An external biasing element also forms a part of this embodiment and serves to hold the switch ball in a switch-opened position until the switch encounters an external body which alters the magnetic field adjacent the switch housing and causes the internal switch ball to move against the bias of the biasing element to a switch-closed position where the conductive ball is in simultaneous electrical contact with the respective electrodes. In a second embodiment, a pair of preferably straight, spaced apart electrodes are supported by the housing cover and extend into the housing. The external biasing element in this embodiment serves to normally hold the ball in a switch-closed position in simultaneous contact with the electrodes. When the magnetic conditions adjacent the housing are altered by the proximity of a magnetically reactive body, the switch ball is shifted against the bias of the element away from the electrodes to thus assume a switch-opened position.

The materials making up the switch ball, biasing element and external magnetically reactive body are cooperatively selected so that the magnetic operation of the switches is made possible. Thus, the spherical ball may be formed as a permanent magnet whereas the biasing element and the external body may be ferromagnetic or some other material having adequate magnetic susceptibility. Alternately, the biasing element and body may be formed of permanent magnetic material while the spherical ball may be formed of any material which is magnetically reactive to the element and body.

DETAILED DESCRIPTION OF THE PREFERRED EMBODIMENT

Figure 1:
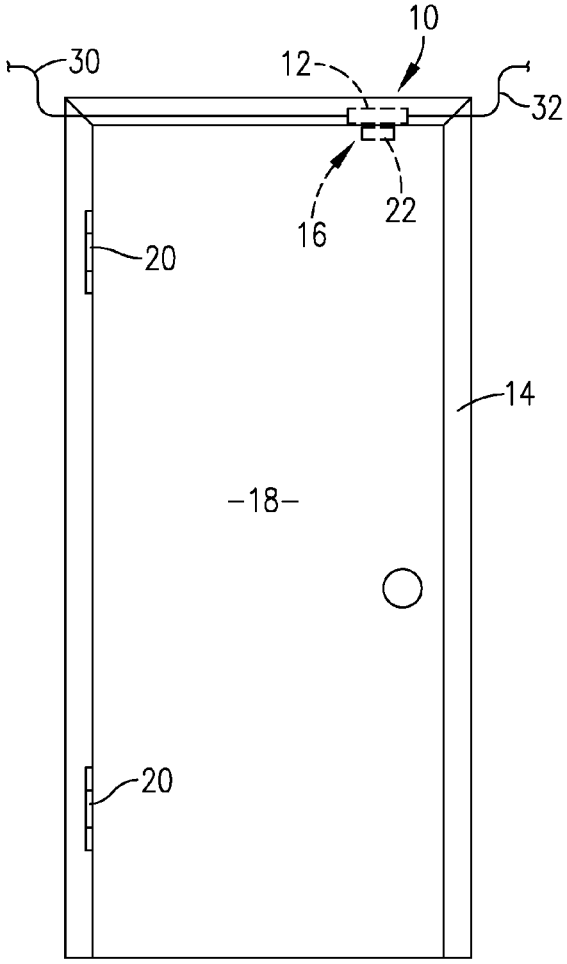
FIG. 1 is an elevational view of a conventional door protected using a security switch in accordance with the invention.

FIG. 1 illustrates a switch assembly 10 including a synthetic resin housing 12 adapted to be mounted within a stationery door frame 14 and housing a magnetic switch 16. In this illustration, the assembly 10 is designed to monitor the condition of door 18 mounted within frame 14 via hinges 20. The switch 16 operates in conjunction with an actuating body 22 mounted on door 18 so that when the latter is closed the body 22 is in direct adjacency with switch 16.

Figure 2:
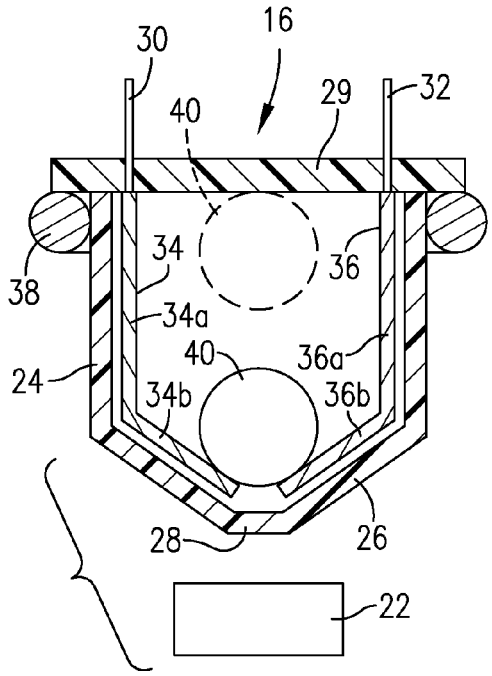
FIG. 2 is an enlarged vertical, sectional view of a preferred magnetic switch in accordance with the invention.

The most preferred switch 16 is illustrated in FIG. 2 and includes a hollow housing 24 presenting a circular in cross-section converging wall 26 terminating in a lowermost wall 28. The housing 24 is surmounted by a top cover 29 having leads 30 and 32 extending therefrom for connection of the switch assembly 16 within an alarm system. In preferred forms, the housing 24 and cover 29 are formed of synthetic resin or other relatively inexpensive, non-conducting material.

A pair of electrically conductive electrodes 34 and 36 are disposed within the confines of housing 24 and are electrically coupled with the leads 30, 32, respectively. As shown, the electrodes 34, 36 are supported by cover 29 and are in a shape generally conforming with the cross-sectional shape of the housing. Thus, each of the electrodes has a depending segment 34*a*, 36*a*, and an angularly oriented segment 34*b*, 36*b*. Note also that the electrode segments are disposed in close adjacency with the inner surface of the housing 24, but are in opposed relationship to each other.

The overall switch 16 further includes an annular biasing ring 38 preferably located about housing 24 and directly beneath cover 29. Also, a spherical switch ball 40 formed of electrically conductive material is located within housing 24 and is shiftable between alternate switch-closed and switch-opened positions as will be described.

The switch 16 operates magnetically, and therefore, the respective components thereof are fabricated from appropriate materials which make possible the desired magnetic operation. For example, the switch ball 40 may be fabricated from a ferromagnetic material (or have an external coating of ferromagnetic material), whereas the biasing ring 38 and body 22 may be composed of permanent magnetic material. Alternately, the element 38 and body 22 may be formed of ferromagnetic material whereas ball 40 may be a permanent magnet.

The foregoing can be better understood from a consideration of the operation of the switch assembly 10. Again in the context of a security system, attention is drawn to FIG. 3 which illustrates the switch 16 and body 22 with an alarm system 48. The switch 16 is coupled via leads 30, 32 to an alarm 50, and the latter is connected with a bell 52 or other perceptible alarm device.

When door 18 is closed, the body 22 is directly adjacent housing 24. In this orientation, owing to the magnetic attraction between the body 22 and ball 40, the latter is drawn downwardly so that the conductive ball comes into simultaneous contact with both of the electrodes 34 and 36, thus achieving a switch-closed position. On the other hand, when door 18 is opened so that housing 24 is remote from body 22, the biasing element 38 comes into play, and the magnetic attraction between the biasing element and the ball 40 causes the latter to move upwardly toward wall 29 and out of simultaneous contact with electrodes 34, 36. This of course establishes the switch-open position.

Figure 3:
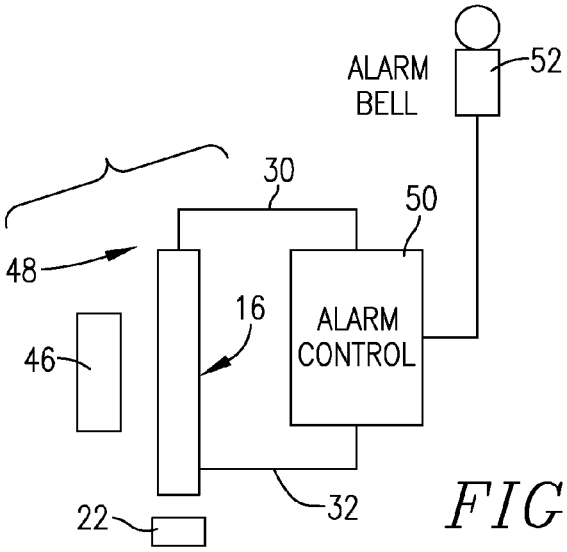
FIG. 3 is a schematic representation depicting the interconnection of magnetic switches of the invention into an alarm system.

The switch 16 is also operable to defeat an attempted use of a secondary magnet 46 (see FIG. 3). That is, conventional reed switches maybe defeated by placing a strong magnet adjacent door frame 14, thereby allowing the door 18 to be opened without triggering the alarm. In the case of switch 16, however, use of such a secondary magnet 46 merely causes ball 40 go be shifted away from the switch-closed position shown in full lines in FIG. 2, to a switch-open position. Thus, the alarm would be sounded and the use of magnet 46 cannot defeat switch 16.

Figure 4:
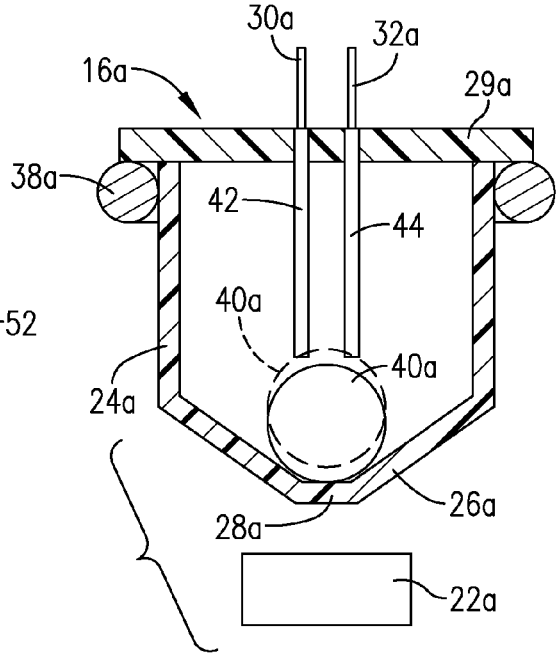
FIG. 4 is a vertical, sectional view similar to that of FIG. 2 but depicting an alternate embodiment.

FIG. 4 depicts a similar switch 16*a*. Because many of the components of 16*a* are essentially identical with those of switch 16, like reference numerals are employed except for the use of the distinguishing letter "a." Thus, the switch 16*a* has housing 24*a* with converging wall 26*a* and bottom wall 28*a*, with cover 29*a* atop the housing. The biasing element 38*a* is positioned about housing 24*a* as shown, beneath cover 29*a*. An electrically conductive contact ball 40*a* is positioned within housing 24*a*. However, in this embodiment, electrodes 42 and 44 are used which extend through cover 29*a* and are coupled to leads 30*a*, 32*a*. As before, the electrodes 42, 44 are formed electrically conductive material such as copper. Finally, the switch 16*a* is cooperable with a body 22*a*.

In operation, where the switch 16*a* is mounted within frame 14 and body 22*a* is in door 18, closure of the door aligns body 22*a* and housing 24*a*. Under these conditions, the magnetic attraction between ball 40*a* and body 22*a* causes the body to move downwardly within housing 24 and out of contact with electrodes42, 44. This is the switch-opened position of this embodiment. However, when door 18 is opened, the magnetic attraction element 38*a* and ball 40*a* magnetically shifts upwardly to the phantom-line position of FIG. 4 where the ball 40*a* is in simultaneous contact with the electrodes 42, 44 to achieve the switch-closed position. Again, the element 38*a*, ball 40*a* and body 22*a* can be variously fabricated from different materials so long as, in operation, the ball 40*a* is magnetically shifted between the switch-close and switch-open positions.

It will also be appreciated that while the switches 16 and 16*a* have been described in the context of a security system for doors or windows for example, the utility of the switches is not so limited. In essence, the switches may be used in any environment where a switch condition change is effected by an alteration in magnetic field conditions adjacent the switch housing. To give but one further example, the switches 16, 16*a* can readily be adapted for use as proximity sensors. In this environment, the switches would signal the presence of a ferromagnetic body for example in lieu of the bodies 22, 22*a*. Thus, the switches can be located at a selected sensing position and in the event that a ferromagnetic body comes into proximity with the switches, a magnetic attraction is effected between the switch ball 40 or 40*a* and the ferromagnetic body.

While the preferred switch housings of the switches 16 and 16*a* may be fabricated from synthetic resin materials, those skilled in the art will appreciate that inexpensive metal or other materials may also be used, so long as the operation of the switches is not unduly impeded or limited.

I claim:

1. A magnetic switch assembly comprising:

a housing formed of non-conductive material;

a cover formed of non-conductive material and secured to said housing;

a first, electrically conductive switch element within said housing;

a second, electrically conductive switch element within said housing and located in spaced relationship to said first switch element;

an electrically conductive body located within said housing and shiftable between a first position in simultaneous contact with said first and second switch elements, and a second position out of simultaneous contact with said first and second switch elements; and a first attractive component comprising a ring located below said cover and in surrounding relationship to said housing, said first attractive component and said body being cooperatively selected and designed so that, when a first magnetic field condition is experienced by said switch assembly, said attractive component is operable to maintain said body in one of said first and second positions, and so that, when a second magnetic field condition is experienced by said switch assembly, said body is moved to the other of said first and second positions under the influence of said second magnetic field condition.

2. The switch assembly of claim 1, said first and second switch elements comprising, elongated, rod-like, electrically conductive electrodes.

3. The switch assembly of claim 2, said housing having a generally cylindrical section and a general conical section, said first and second switch elements extending along and in conforming relationship to said housing sections.

4. The switch assembly of claim 2, said first and second switch elements being substantially rectilinear and extending into the confines of said housing.

5. The switch assembly of claim 1, said body comprising a spherical ball.

6. The switch assembly of claim 1, said first attractive component comprising a magnetic biasing ring disposed about said housing.

7. The switch assembly of claim 1, said body being a spherical ball formed of permanently magnetic material, and said first attractive component formed of magnetically susceptible material.

8. The switch assembly of claim 1, said first attractive component formed of permanent magnetic material, and said body being a spherical ball formed of material which is magnetically reactive to said first attractive component.

9. The switch assembly of claim 1, including a second attractive component adapted to be mounted upon an adjacent, shiftable structure.

10. The switch assembly of claim 9, said second attractive component being formed of material selected from the group consisting of permanently magnetized materials and magnetically susceptible materials.

11. The switch assembly of claim 1, said switch assembly being adapted for mounting adjacent a doorway for monitoring the position of a door within the doorway.

12. The switch assembly of claim 1, said switch assembly being adapted for mounting adjacent a window frame for monitoring the position of a window within a window frame.

13. The switch assembly of claim 1, said switch assembly being adapted for mounting as a proximity sensor to monitor magnetic conditions adjacent said housing.

14. The switch assembly of claim 1, said top cover formed of non-conductive synthetic resin material.

15. The switch assembly of claim 1, said housing formed of synthetic resin material.

* * * * *